United States Patent [19]

Weise

[11] 4,423,889

[45] Jan. 3, 1984

[54] WELL-TUBING EXPANSION JOINT

[75] Inventor: Stanley A. Weise, Dallas, Tex.

[73] Assignee: Dresser Industries, Inc., Dallas, Tex.

[21] Appl. No.: 173,302

[22] Filed: Jul. 29, 1980

[51] Int. Cl.[3] ..... F16L 55/00

[52] U.S. Cl. ..... 285/39; 285/86; 285/302; 285/315; 285/319

[58] Field of Search ..... 285/39, 302, 18, 3, 285/4, 86, 315, 319, 23; 166/242; 175/321

[56] References Cited

U.S. PATENT DOCUMENTS

| | | | |
|---|---|---|---|
| 3,354,950 | 11/1967 | Hyde | 285/302 |
| 3,504,936 | 4/1970 | Brown et al. | 285/302 |
| 3,764,168 | 10/1973 | Kisling et al. | 285/302 |
| 3,966,236 | 6/1976 | Vann | 285/315 X |
| 4,040,649 | 8/1977 | Blackwell | 285/3 |
| 4,066,282 | 1/1978 | Vann | 285/319 X |
| 4,074,912 | 2/1978 | Bilderbeek | 285/39 |
| 4,281,858 | 8/1981 | Bowyer | 285/3 |

OTHER PUBLICATIONS

Composite Catalogue of Oil Field Equipment and Services 1974–1975, p. 3931.

*Primary Examiner*—Dave W. Arola

*Attorney, Agent, or Firm*—J. N. Hazelwood; W. R. Peoples

[57] ABSTRACT

An expansion joint for use with a retrievable packer includes a stop to limit the extent to which the joint may be extended and for providing vertical support for packer retrieval and further includes and interfitting key and slot acting between a housing and a mandrel telescoped into the housing in order to transmit torque through the joint.

2 Claims, 4 Drawing Figures

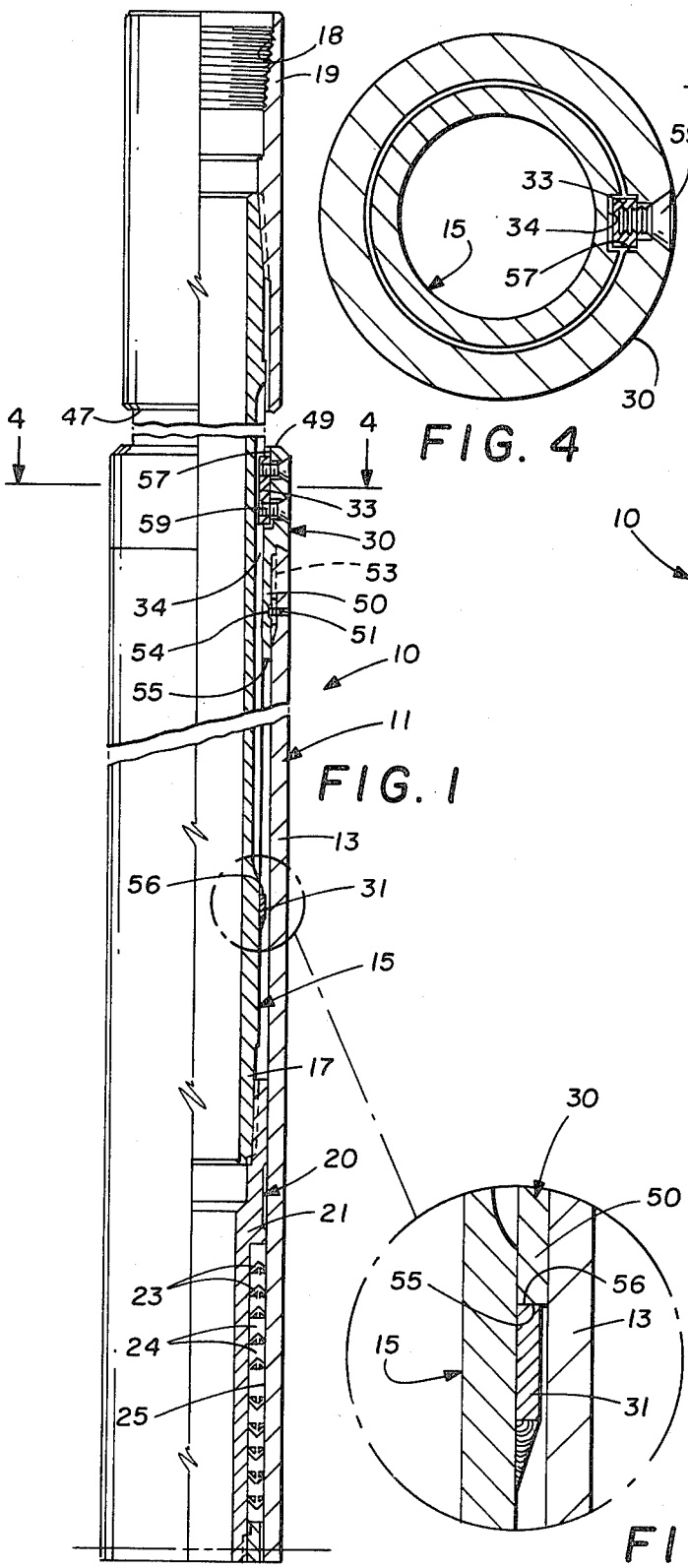
FIG. 1
FIG. 4
FIG. 3
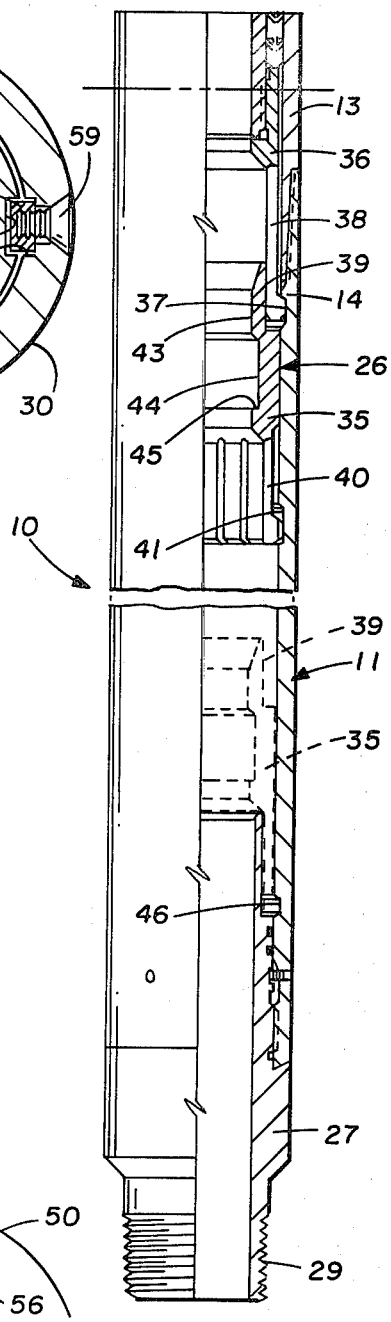
FIG. 2

WELL-TUBING EXPANSION JOINT

TECHNICAL FIELD

The present invention relates to an expansion-contraction joint for use in a well tubing string and, more particularly, relates to the type of expansion-contraction joint comprised of telescoped tubular parts.

BACKGROUND ART

As disclosed in U.S. Pat. No. 4,040,649 an expansion-contraction joint may be used in the tubing string of an oil or gas well in conjunction with a packer in order to compensate for expansion and contraction in an upper section of the tubing extending between the well head and the packer. The expansion joint functions to relieve the tubing of stresses due to expansion or contraction such as may be caused by temperature changes or otherwise after the packer is set by allowing telescoped parts of the joint to move relative to each other.

When installing a packer in a well, it may be desirable for the expansion joint to remain immobilized until after the packer is set. This may be necessary in order for the joint to carry the weight of the tubing string when positioning the packer in the well, and to allow the well head to be secured to the casing for production purposes as soon as possible after setting the packer. To these ends, the aforementioned patent discloses an expansion joint which includes a tubular housing having a mandrel telescoped into the housing and carrying a series of stacked sealing rings to seal against the loss of production fluid from between the mandrel and housing. Connected to the lower end of the mandrel is a locking mechanism which may be hydraulically released from holding the mandrel in some intermediate position to free the mandrel for sliding longitudinally within the housing between fully collapsed and fully extended positions. In this way the joint may be released after the packer is set in order to compensate for expansion and contraction in the upper section of the tubing string.

When an expansion-contraction joint is used in conjunction with a retrievable packer, it is desirable that the expansion joint be capable of again bearing the weight of the tubing string and of transmitting torque through the tubing string when disengaging the packer slips and removing the packer from the well. Another prior art expansion joint having this capability is shown in the "Composite Catalogue of Oil Field Equipment and Services", 1974–75 at page 3931 and includes a locking mechanism which may be released and reset mechanically through the use of a wireline tool. In resetting this locking mechanism, however, it is necessary to rerun a wireline tool through the tubing string while at the same time relocating relatively slidable moving parts of the expansion joint in their originally set positions.

DISCLOSURE OF THE INVENTION

The present invention contemplates an improved well-tubing expansion joint which is wireline released from a centralized load-carrying position to compensate for both tubing expansion and contraction while also enabling the packer to be retrieved from the well without the necessity of having to reset the joint in its centralized position. More particularly, the present invention resides in the construction of a well-tubing expansion joint to provide for both load-bearing support for the tubing string beneath the joint when the latter is fully extended and for the transmission of torque through the joint. Herein, the present invention provides a stop collar connected to the joint housing for engagement with an annular abutment on the mandrel to keep the mandrel and housing from separating when the joint is fully extended. Additionally, a key connected to the collar extends into a longitudinal slot in the mandrel and prevents relative rotation between the mandrel and the housing. This unique construction provides operational advantages in well servicing by enabling packer retrieval without having to reset the expansion joint in its centralized position and without having to rerun a wire-line tool into the well in order to reset the joint for packer retrieval.

The invention also resides in the novel locking mechanism whereby a collet locking collar normally captivates a spring fingered collet in a latch position to hold the mandrel and housing together for load bearing purposes but is moveable on the housing into an out-of-the-way position disposed beneath the mandrel to release the collet fingers.

These and other advantages of the present invention will become more apparent from the following description when taken in conjunction with the accompanying drawings.

BRIEF DESCRIPTION OF DRAWINGS

FIGS. 1 and 2 combined represent a partial elevational and partial cross sectional view of a well-tubing expansion joint embodying the novel features of the present invention.

FIG. 3 is an enlarged fragmentary cross-sectional view of a portion of the exemplary expansion joint shown in FIGS. 1 and 2 but showing a part of the joint in a moved position.

FIG. 4 is an enlarged cross-sectional view taken substantially along line 4—4 of FIG. 1.

BEST MODE OF CARRYING OUT THE INVENTION

As shown in the drawings for purposes of illustration, the present invention is embodied in a well-tubing expansion joint 10 such as may be incorporated in the tubing string of an oil or gas well to compensate for expansion and contraction in the tubing string such as may be caused by temperature changes in the tubing or otherwise. Herein, the joint comprises a tubular housing 11 with upper and lower sections 13 and 14 threaded together. Telescoped into the housing is a mandrel 15 having upper and lower externally threaded end portions 16 and 17. Threaded on the upper end section of the mandrel is a top connector 19 having an internally threaded section 18 for connection to the lower end of an upper section of tubing in the well. Attached to the lower end portion 17 of the mandrel is a sealing unit 20 including a tubular member 21 with a series of alternately stacked annular seals 23 and spacers 24. The seals slidably engage a smooth inner wall 25 of the housing to keep well fluids from leaking between the mandrel 15 and the housing 11.

At the lower end of the sealing unit 20, a releasable locking mechanism 26 (see FIG. 2) is secured to the sealing unit and connects with the housing 11 to lock the mandrel 15 and the housing together with the sealing unit positioned centrally in the housing so that once released, the joint 10 provides for approximately the same relative distance of travel between the mandrel and the housing in either longitudinal direction. Beneath the locking mechanism 26 a bottom coupling 27 is threaded onto the lower end of the lower section 14 of the housing and is provided with a tapered externally threaded section 29 for connection of the lower end of the joint within the tubing string.

Typically, an expansion joint of the foregoing described character is used in conjunction with a packer and is held locked in its centralized position as the packer is lowered into position and set in the well. Thereafter, the joint is released to compensate for changes in the length of the tubing above the packer due to expansion or contraction. When the tubing expands, the joint collapses with the sealing unit 20 sliding downwardly within the housing. Conversely, when the tubing contracts, the joint expands with the sealing unit sliding upwardly within the housing.

The present invention contemplates a new and improved form of well-tubing expansion joint 10 which is wireline released from its centralized position and which, when fully extended, serves both to support the load of the lower section of tubing and to transmit torque to enable packer retrieval without having to reset the joint. For these purposes, a stop 30 on the housing 11 is engaged by an abutment 31 on the mandrel 15 and a key and slot connection 33, 34 is provided between the mandrel and the housing for transmitting torque. Additionally, the locking mechanism 26 includes a wireline moveable collet lock 35 slidably mounted on the housing for movement between an upper position holding a spring-fingered collet 36 to latch the mandrel 15 and housing 11 together, and a lower out-of-the-way position. By virtue of this construction, the expansion joint may be easily released after the packer is set and the packer may be retrieved without having to reset the joint.

More particularly in the present instance, the releasable locking mechanism 26 is constructed with the spring-fingered collet 36 threaded on the lower end of the tubular member 21 of the sealing unit 20 so that the spring fingers 38 of the collet snap-fit within an annular recess 37 formed in the inner wall 25 of the lower housing section 14. Also slidably mounted on the inner wall of the housing is the collet lock 35 which herein is in the form of a locking sleeve having a annular notch 39 formed in the upper end portion thereof to receive the lower end portion of the spring fingers 38 of the collet 36. With the spring fingers of the collet received in the annular notch of the locking sleeve 35, the fingers are kept from flexing radially inward and thus the mandrel and housing are securely locked together. Formed on the lower end portion of the locking sleeve 35 is a second set of spring fingers 40 adapted to engage with a second annular recess 41 in the inner wall 25 of the housing to position the locking sleeve upwardly within the housing so that the sleeve captivates the spring fingers 38 of the collet 36 within the upper housing recess 37.

For shifting the locking sleeve 35 downwardly within the housing 11, an interior wall 43 of the locking sleeve is provided with a recess 44 having a suitable profile with a shoulder 45, adapted to accept a wireline jarring tool (not shown) for moving the locking sleeve from its upper most position into a lower position with the sleeve spaced beneath the spring fingers 38 of the spring-fingered collet 36. In the sleeve's lower position (phantom position FIG. 2), the second set of spring fingers 40 snap fits within a third annular recess 46 in the inner wall 25 of the housing and thus holds the sleeve in its lower out-of-the-way position.

Once the packer is set and the jarring tool is removed, the joint 10 is free to move to compensate for expansion or contraction in the upper section of the tubing string. In the exemplary joint, the length of tubing expansion without stressing the upper section of the tubing is limited by the extent to which the joint may be collapsed, that is, by engagement of the lower end 47 of the top connector 19 and the upper side 49 of the stop 30. In the other direction, tubing contraction is limited by engagement of the stop 30 and the abutment 31 between the the housing 11 and the mandrel 15. As shown more particularly herein, the stop comprises a collar 30 having a depending, externally-threaded annular skirt 50 threaded on the upper section 13 of the housing 11. Beneath a threaded section 53 of the skirt, is an annular slot 54 adapted to receive the inner ends of a number of set screws 51 extending through the housing and into engagement with the skirt to prevent the stop collar from being turned loose from the housing. The downwardly facing lower end of the skirt provides a shoulder 55 engageable with an upwardly facing surface 56 of the abutment 31 (see also FIG. 3). In the present instance, the latter is defined by an annular flange fixed to the exterior surface of the mandrel and extending radially outward therefrom. With this arrangement, when removing the tubing string from the well, engagement of the abutment 31 with the shoulder 55 is sufficient to support the weight of the packer and the tubing beneath the joint 10.

In order to transmit torque through the joint, the key 33 is secured within a longitudinal groove 57 (see FIGS. 1 and 4) in the stop collar 30 such as by means of screws 59 and extends radially inward into the longitudinal slot 34. Herein, the latter is formed within the mandrel and, as seen in FIG. 1, extends parallel with the axis of the mandrel to provide for free sliding vertical movement of the mandrel within the housing between fully collapsed and fully extended positions of the joint. The key and slot connection 33, 34, however, provides for the transmission of torque through the joint as the sides of the key engage the sides of the slot during rotation of the tubing string and in turn, the mandrel.

In view of the foregoing, it is seen that the present invention brings to the art a new and improved well-tubing expansion joint 10 particularly constructed to provide for both carrying the weight of the tubing string and for transmitting torque through the tubing string for retrieving a packer previously set within the well.

The embodiments of an invention in which an exclusive property or privilege is claimed are defined as follows:

1. An expansion-contraction joint for connection between upper and lower sections of well tubing including:

a tubular housing with a lower end portion adapted for connection to the lower section of tubing;

a mandrel with an upper end portion adapted for connection to the upper section of tubing and a lower end portion telescoped into the housing, sealing means carried by one of said mandrel and said housing and sealing therebetween intermediate opposite ends of said housing, releasable locking means connected between said mandrel and said housing for normally supporting said mandrel in a central position against movement within said housing and being releasable to free said mandrel for movement in either longitudinal direction within said housing between fully collapsed and extended positions to compensate for expansion and contraction within said well tubing, said releasable locking means including, a releasable latching member connectable between said lower end portion of said mandrel and said housing and normally latching said housing and said mandrel together, and a wireline releasable, locking sleeve movable within said housing between an upper position locking said latching member against movement from its normally latched central position and a lower position releasing said latching member so said mandrel is free to slide within said housing, said lower position being located out of the way beneath the lower end of said mandrel when the latter is in its fully collapsed position, and said locking sleeve including, a plurality of spring finger latches extending therefrom, with said housing having upper and lower mating recesses for said spring finger latches to releasably catch therein for holding said sleeve releasably within said housing in said upper and lower positions, respectively, a stop collar connected to said housing and having an annular shoulder disposed between said housing and said mandrel, and means on said collar and housing preventing relative rotation therebetween and key means extending radially inward from said collar, a longitudinal slot formed in said mandrel and receiving said key to lock said collar and said mandrel against relative rotational movement, and an annular abutment fixed to said mandrel and extending toward said housing for engagement with said annular shoulder to limit said mandrel to its fully extended position.

2. An expansion-contraction joint for connection between upper and lower sections of well tubing including:

a tubular housing with a lower end portion adapted for connection to the lower section of tubing;

a mandrel with an upper end portion adapted for connection to the upper section of tubing and a lower end portion telescoped into the housing, sealing means carried by one of said mandrel and said housing and sealing therebetween intermediate opposite ends of said housing, releasable locking means connected between said mandrel and said housing for normally supporting said mandrel in a central position against movement within said housing and being releasable to free said mandrel for movement in either longitudinal direction within said housing between fully collapsed and extended positions to compensate for expansion and contraction within said well tubing, said releasable locking means including, a releasable latching member connectable between said lower end portion of said mandrel and said housing and normally latching said housing and said mandrel together, and a wireline releasable, locking sleeve movable within said housing between an upper position locking said latching member against movement from its normally latched central position and a lower position releasing said latching member so said mandrel is free to slide within said housing, said lower position being located out of the way beneath the lower end of said mandrel when the latter is in its fully collapsed position, and said locking sleeve including, a plurality of spring finger latches extending therefrom, with said housing having upper and lower mating recesses for said spring finger latches to releasably catch therein for holding said sleeve releasably within said housing in said upper and lower positions, respectively, and stop means disposed between said housing and said mandrel for preventing relative rotation between and axial separation of said housing and said mandrel and thereby limiting movement of said mandrel to its fully extended position while providing for the transmission of torque between said mandrel and said housing.

* * * * *